US007861538B2

(12) United States Patent
Welle et al.

(10) Patent No.: US 7,861,538 B2
(45) Date of Patent: Jan. 4, 2011

(54) THERMOELECTRIC-BASED REFRIGERATOR APPARATUSES

(75) Inventors: Richard P. Welle, Huntington Beach, CA (US); Siegfried W. Janson, Redondo Beach, CA (US)

(73) Assignee: The Aerospace Corporation, El Segundo, CA (US)

( * ) Notice: Subject to any disclaimer, the term of this patent is extended or adjusted under 35 U.S.C. 154(b) by 928 days.

(21) Appl. No.: 11/460,156

(22) Filed: Jul. 26, 2006

(65) Prior Publication Data

US 2008/0022696 A1 Jan. 31, 2008

(51) Int. Cl.

| | |
|---|---|
| ***F25B 21/02*** | (2006.01) |
| ***F23N 1/00*** | (2006.01) |
| ***H01L 35/28*** | (2006.01) |
| ***H01L 35/02*** | (2006.01) |

(52) U.S. Cl. ..... 62/3.62; 62/3.2; 62/3.3; 62/3.6; 62/3.7; 236/94; 136/203; 136/231

(58) Field of Classification Search ..... 62/3.7, 62/3.2, 3.3, 3.6, 3.62; 236/94; 136/203, 136/231

See application file for complete search history.

(56) References Cited

U.S. PATENT DOCUMENTS

| | | | | |
|---|---|---|---|---|
| 3,973,938 | A | 8/1976 | Szabo et al. | |
| 4,089,184 | A | 5/1978 | Beitner | |
| 4,326,383 | A | 4/1982 | Reed et al. | |
| 4,364,234 | A | 12/1982 | Reed | |
| 4,407,133 | A | 10/1983 | Edmonson | |
| 4,581,898 | A | 4/1986 | Preis | |
| 4,671,070 | A | 6/1987 | Rudick | |
| 4,704,870 | A | 11/1987 | Beitner | |
| 5,247,798 | A | 9/1993 | Collard, Jr. | |
| 5,353,600 | A | 10/1994 | Merritt et al. | |
| 5,483,799 | A | 1/1996 | Dalto | |
| 5,572,873 | A | 11/1996 | Lavigne et al. | |
| 5,704,223 | A | 1/1998 | MacPherson et al. | |
| 5,865,032 | A | 2/1999 | MacPherson et al. | |
| 6,230,501 | B1 | 5/2001 | Bailey, Sr. et al. | |
| 6,253,570 | B1 | 7/2001 | Lustig | |
| 6,282,906 | B1 | 9/2001 | Cauchy | |
| 6,484,512 | B1 | 11/2002 | Anderson et al. | |
| 6,588,217 | B2 * | 7/2003 | Ghoshal | 62/3.7 |
| 6,729,144 | B1 * | 5/2004 | Kupferman | 62/3.6 |
| 2001/0029740 | A1 | 10/2001 | Evans et al. | |
| 2002/0104318 | A1 * | 8/2002 | Jaafar et al. | 62/3.6 |
| 2002/0139123 | A1 | 10/2002 | Bell | |
| 2004/0049320 | A1 * | 3/2004 | Takai et al. | 700/278 |
| 2005/0016198 | A1 * | 1/2005 | Wowk et al. | 62/371 |
| 2006/0157101 | A1 * | 7/2006 | Sakamoto et al. | 136/201 |

OTHER PUBLICATIONS

U.S. Appl. No. 11/460,128 (complete file history through Office Action mailed on May 13, 2010).

* cited by examiner

*Primary Examiner*—Frantz F Jules
*Assistant Examiner*—Travis Ruby
(74) *Attorney, Agent, or Firm*—Henricks, Slavin & Holmes LLP

(57) ABSTRACT

A refrigerator apparatus includes a housing with an interior chamber, thermoelectric devices that are thermally coupled to the interior chamber, and dual redundant electronics configured to generate and apply input power to the thermoelectric devices.

26 Claims, 8 Drawing Sheets

THERMOELECTRIC-BASED REFRIGERATOR APPARATUSES

CROSS-REFERENCE TO RELATED APPLICATIONS

This application is related to U.S. patent application Ser. No. 11/460,128 entitled "Input Power Control for Thermoelectric-Based Refrigerator Apparatuses" filed herewith.

TECHNICAL FIELD

The invention relates generally to refrigeration devices and, in particular, to micro refrigerators.

BACKGROUND ART

Millions of people in the U.S. with diabetes depend on a reliable supply of insulin. Although insulin can be readily purchased, and has a reasonable shelf life, it needs to be stored under proper conditions. Insulin is a protein that can be degraded by exposure to excessive heat or cold. In particular, even brief exposure to temperatures below 2° C. or above 30° C. can cause unacceptable degradation. In general, it is recommended that insulin be stored in a refrigerator for extended storage, but room temperature storage for periods up to a month is also considered acceptable, provided that the room temperature does not exceed 30° C. (86° F.). Many insulin users are satisfied with keeping a supply in their refrigerator. However, refrigerators occasionally are set at a temperature too low for safe storage of insulin, and insulin can accidentally be frozen. In addition, insulin users who travel regularly are often faced with issues, such as hotel rooms that do not provide refrigerators, and long airplane flights. During travel in such unpredictable environments, it is possible that the insulin could be exposed to damaging temperatures, even without the knowledge of the owner.

The only devices currently on the market aimed at providing portable personal refrigerated insulin storage are phase-change devices. These are devices that contain a fluid/solid that melts near 10° C.; they are essentially ice packs. The fluid might be water, or some water-based fluid. Like an ice pack, prior to use, they must be pre-chilled in a freezer. The heat of fusion absorbed as the solid melts is used to keep it cold for an extended period.

Several difficulties are encountered with these devices. Among these are that temperature control is marginal; the device starts at freezer temperature (which is too low for safe insulin storage) and gradually warms to the phase change temperature. The temperature then remains fairly constant until all of the phase-change material melts, at which time the temperature begins to rise again. If the phase-change material is water, the temperature plateau is at 0° C., which is again too cold for long-term insulin storage. Phase-change materials can be found that melt at 10° C., but they do not have the high heat of fusion of water, limiting the lifetime of the device. Lifetime of the devices is also limited if the mass of the phase-change material is to be kept reasonable. In addition, there is no reliable indicator of when the solid is nearly or completely exhausted. The user only knows it is time to recharge the device when it begins to get too warm. Finally, the only way to recharge the device is to leave it in a freezer for some time; the user is then faced with the issues of finding a freezer, and of where to keep the insulin while the storage device is being recharged (since it is not safe to leave the insulin in the device while it is in the freezer).

It would be useful to be able to provide a portable refrigeration device that helps prevent unacceptable degradation of a substance stored therein.

DISCLOSURE OF INVENTION

The present invention involves refrigerator apparatuses, for example, portable micro refrigerators for insulin or other medicines, drugs and materials that require storage in a temperature controlled environment.

In example embodiments, refrigerator apparatuses are controlled according to one or more operating modes. In an example operating mode, the measured temperature of a substance stored in the refrigerator apparatus is allowed to vary over some or all of the temperature range under which the substance (e.g., insulin) can be safely stored without significant degradation. For refrigerator apparatuses that use batteries as a power source, this and other operating modes described herein increases the lifetime of the battery.

Figure 1:
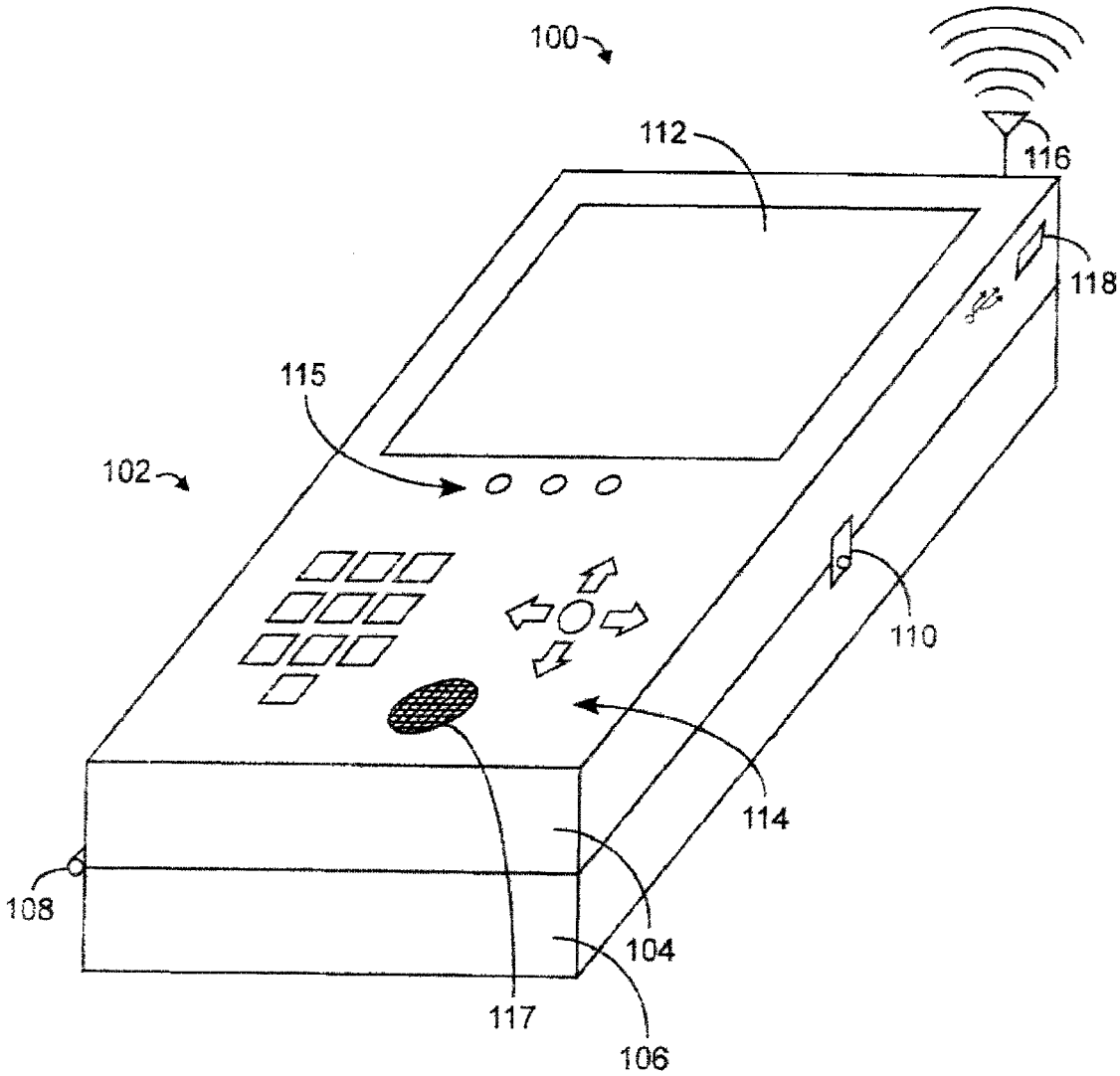
FIG. 1 is a perspective view of a refrigerator apparatus according to an example embodiment of the present invention.

Referring to FIG. 1, in an example embodiment, a refrigerator apparatus 100 includes a housing 102. In this example embodiment, the housing 102 includes a top portion 104 and a bottom portion 106. In this example embodiment, a hinge 108 mechanically couples the top portion 104 and the bottom portion 106, and a latch 110 secures the portions of the housing in a closed position as shown. It should be appreciated that other mechanisms can be used to secure the top portion 104 and the bottom portion 106 together.

In this example embodiment, the top portion 104 includes a display 112 (e.g., LCD, touch screen), user input mechanisms 114 (such as a numeric keypad, arrow buttons, etc.), indicator lights 115 (e.g., LEDs), and a speaker 117. In this example embodiment, the refrigerator apparatus 100 also includes a wireless communications interface 116 (e.g., Bluetooth) and a wired communications interface 118 (e.g., USB). Other input mechanisms, indicators, communications interfaces and/or combinations of these devices can also be employed. In this example embodiment, the top portion 104 and the bottom portion 106 are both provided with access to the communications interfaces 116 and 118 (e.g., via a signal interface such as a ribbon cable providing a communications link between the top portion 104 and the bottom portion 106).

Example embodiments are configured to permit programming of the refrigerator apparatus 100. In an example embodiment, one or more of the communications interfaces 116 and 118 are used to download executable program files and/or data (e.g., related to control modes for particular substances and particular environmental or other conditions). In an example embodiment, the user input mechanisms 114 allow a clinician or other user of the refrigerator apparatus 100 to provide data inputs and/or navigate a Graphical User Interface (GUI) provided at the display 112. In an example embodiment, one or more of the display 112, indicator lights 115, and speaker 117 is used to provide an indication of a condition (e.g., associated with a measured temperature, temperature history, state of battery charge, or operational status of a component within the refrigerator apparatus 100), or to prompt the user to provide a data input (e.g., make a decision regarding selection of an operating mode), establish a remote communications link (e.g., to download software updates), discard/replace a stored substance that may have become degraded, or to take some other recommended or required action.

For example, the refrigerator apparatus 100 can be configured (programmed) to monitor temperature extremes to which a stored substance has been exposed, and notify the user (through the display 112, indicator lights 115 and speaker 117, for example) that the substance has been exposed to unacceptable temperatures. Also by way of example, the refrigerator apparatus 100 can be programmed to monitor battery voltage and provide an indication (e.g., activate an alarm) when battery capacity is running low.

Figure 2A:
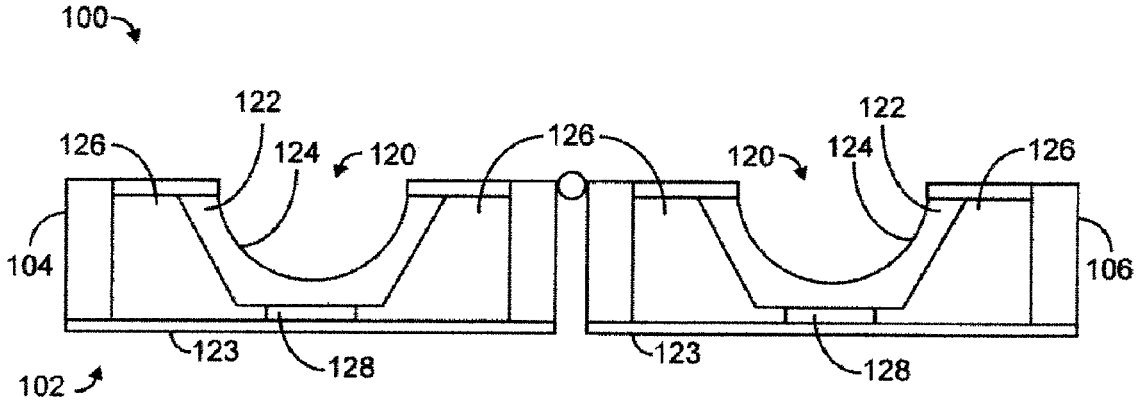
FIG. 2A is a cross-sectional end view of the refrigerator apparatus of FIG. 1, shown with its housing opened to provide access to the interior chamber.
Figure 2B:
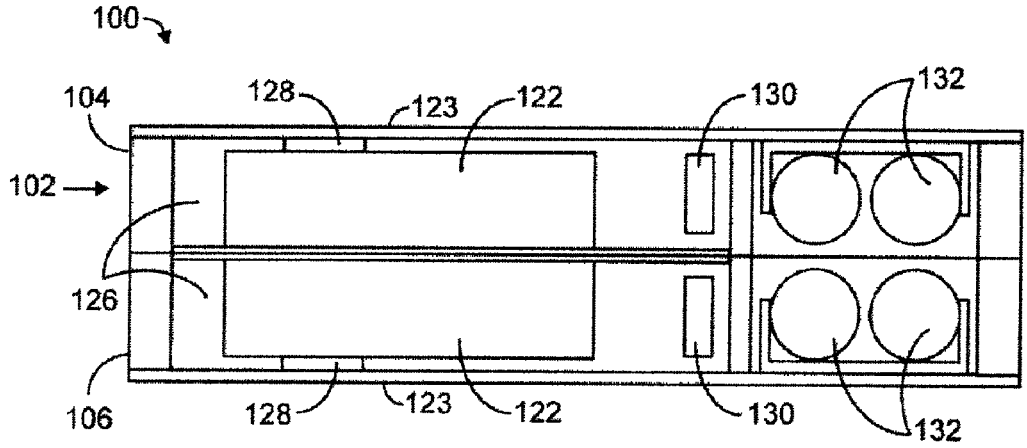
FIG. 2B is a cross-sectional side view of the refrigerator apparatus of FIG. 1.
Figure 2C:
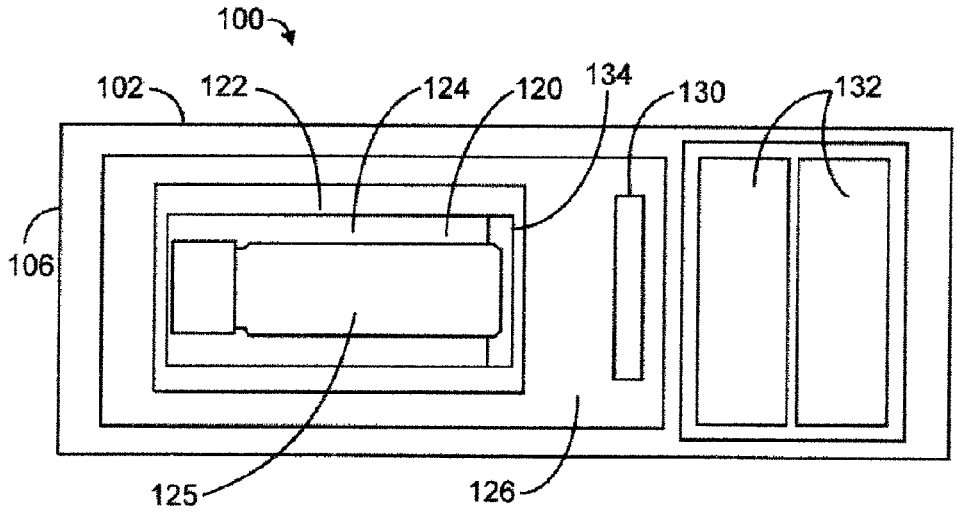
FIG. 2C is a cross-sectional top view of the refrigerator apparatus of FIG. 1.

Referring to FIGS. 2A-2C, in an example embodiment, the refrigerator apparatus 100 includes an interior chamber 120 which is defined by chamber walls 122 of the top portion 104 and the bottom portion 106, respectively. The chamber walls 122, as well as the outer walls 123, are made of aluminum, for example, or any material(s) with good thermal conductivity. In an example embodiment, the interior chamber 120 is complementary in shape to a container 125 in which a substance is stored. In an example embodiment, inner surfaces 124 of the chamber walls 122 are semi-circular in shape as shown.

In this example embodiment, the refrigerator apparatus 100 includes insulators 126 (e.g., aerogel insulators) and thermoelectric devices 128 adjacent to the chamber walls 122 of each housing portion as shown. The insulators 126 control the heat load on the cold side of the thermoelectric devices 128. Each of the housing portions also includes electronics 130 (e.g., an electronics module) and batteries 132 for providing input power.

In an example embodiment, a refrigerator apparatus includes a housing with an interior chamber, an aerogel insulator within the housing, a thermoelectric device that is thermally coupled to the interior chamber, and electronics configured to generate and apply input power to the thermoelectric device. In an example embodiment, the aerogel insulator is molded. In an example embodiment, the aerogel insulator includes layers of aerogel fabric. In an example embodiment, the aerogel insulator is under a vacuum.

In an example embodiment, the interior chamber 120 is configured to provide a data input to the electronics 130 that identifies the substance within the container 125. In this example, an ID reader 134 is provided within the interior chamber 120. By way of example, the ID reader 134 is complementary in shape to a base portion of the container 125. This facilitates proper seating of the container 125 so that machine-readable indicia or the like (e.g., a bar code) carried on the base portion of the container 125 can be read, thereby providing an identification of a substance within the container 125. This identification data is in turn provided to the electronics 130 which, in example embodiments, are configured to automatically select particular operating modes or other temperature control schemes that are customized to the particular needs of the identified substance.

In the illustrated example embodiment, the two halves (top portion 104 and bottom portion 106) are completely independent in power supply and cooling elements, providing redundancy. In an example embodiment, the thermoelectric devices 128 are controlled by their respective electronics 130 to pump heat from the chamber walls (cold cell) 122 to the outer walls (case) 123. In an example embodiment, the case is made of a good thermal conductor (such as aluminum) and is large enough to dissipate the heat without noticeable temperature rise. In the illustrated example embodiment, power is supplied to each of the two halves (top portion 104 and bottom portion 106) by two pairs of batteries 132 (e.g., AA batteries). The batteries 132 can be, but are not required to be, rechargeable batteries. In an example embodiment, the electronics 130 controls the power to maintain the desired temperature on the cold side.

In an example embodiment, a refrigerator apparatus includes a housing with an interior chamber, thermoelectric devices that are thermally coupled to the interior chamber, and dual redundant electronics configured to generate and apply input power to the thermoelectric devices. In an example embodiment, the dual redundant electronics are configured to maintain for each of the thermoelectric devices a functional relationship between the input power and a temperature measurement. In an example embodiment, the dual redundant electronics include dual microcontrollers each configured for direct connection to a battery without the use of a voltage regulator.

Figure 3:
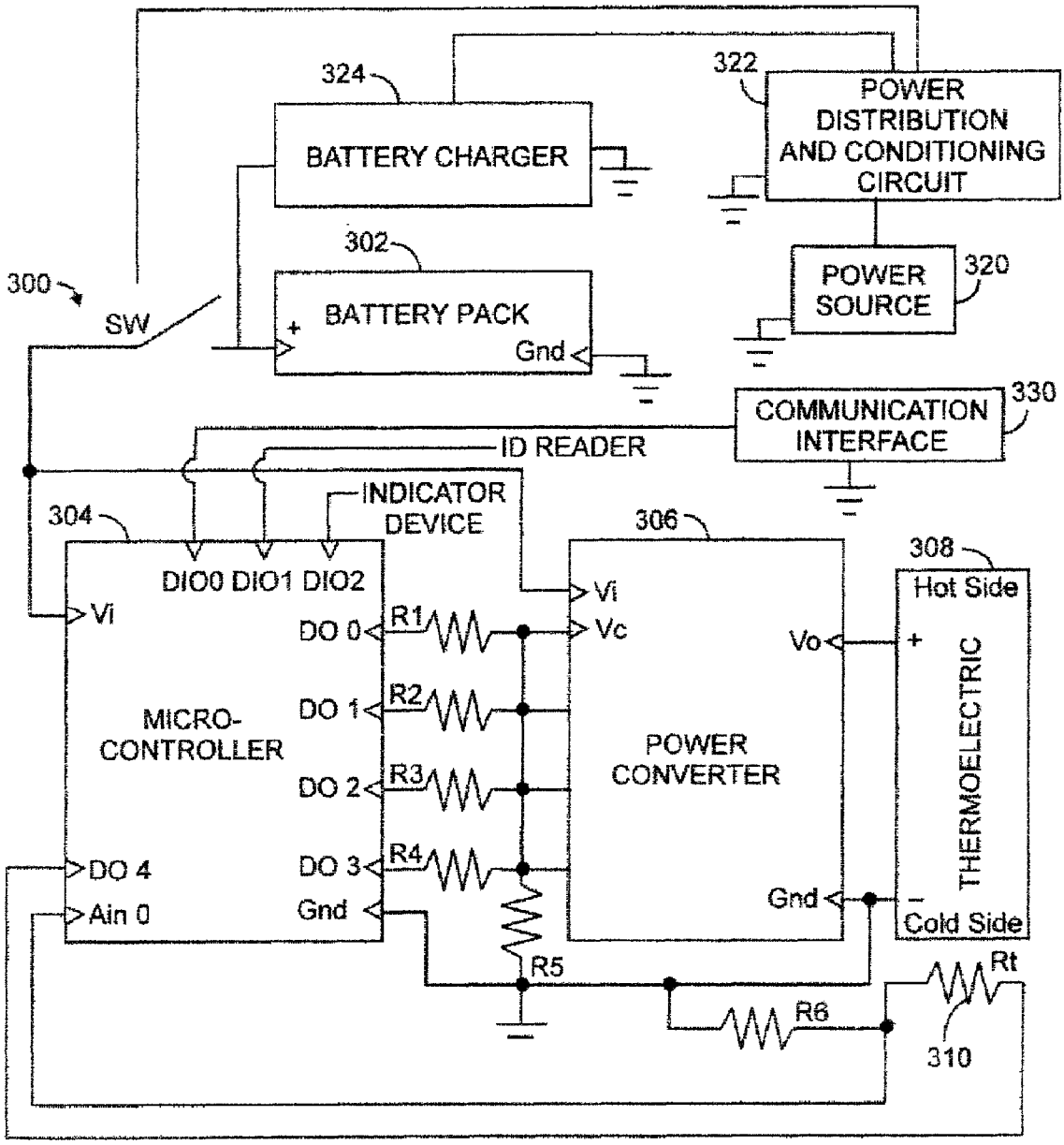
FIG. 3 shows an example embodiment of electronics for a refrigerator apparatus, the electronics including a single cold side temperature sensor.

FIG. 3 shows an example embodiment of electronics 300 for a refrigerator apparatus. In this example embodiment, the electronics 300 include a battery pack 302, microcontroller 304, power converter 306, thermoelectric 308, thermistor 310, power source 320, power distribution and conditioning circuit 322, battery charger 324, and communications interface 330 configured as shown. Switch SW is a single pole, double throw switch that connects the circuitry to either the battery pack 302 or the output of the power distribution and conditioning circuit 322. The microcontroller 304 monitors a temperature sensor, the thermisor Rt in this example embodiment, and calculates an appropriate operating voltage for the thermoelectric 308. In this example embodiment, an analog voltage is generated using 4 digital outputs (DO 0 through DO 3) and a resistor divider network (R1 through R5). Other techniques such as low-pass filtering of a high-frequency pulse-width modulated digital output can be used to provide an analog output voltage using fewer output ports and components, or direct digital output can be used with a power converter designed for digital inputs. In this example embodiment, the power converter 306 is an analog power converter which acts as an impedance-matching amplifier to drive the thermoelectric cooler. Microcontrollers have high-impedance digital outputs while thermoelectric coolers tend to be low-impedance devices. The power converter 306 provides unity gain or some other fixed gain as required.

In an example embodiment, the thermistor 310 is part of a resistor divider with R6. When the DO 4 digital output is driven high, current flows through the thermistor and R6. The voltage of the thermistor-R6 junction, read by analog input 0 (Ain 0) is a function of temperature. With appropriate choice of R6, the analog input voltage will be proportional to temperature. Use of a digital output to activate the thermistor circuit allows reduced energy consumption since temperature measurements are not required continuously. The thermal time constants are typically longer than a few seconds and the temperature can be measured by the microcontroller 304 within a tenth of a second.

In an example embodiment, the electronics 300 include a single cold side temperature sensor (the thermistor 310). It should be appreciated, however, that temperature sensors other than thermistors can also be used.

An additional energy conservation approach is the direct connection of microcontrollers to batteries without the use of a voltage regulator. By way of example, a pair of 1.5-V alkaline batteries, connected in series, produces an output voltage between 0 and 3.0 Volts, depending on the state of discharge for the batteries. The output voltage for a pair of batteries that have been drained by 90% over the course of at least an hour is about 2.0 Volts. Current-generation microcontrollers are capable of operating over a 1.7-to-5 Volt supply range, and are thus capable of operating directly on batteries down to ~10% of their remaining capacity. Use of a voltage regulator to power the microcontroller would suffer from a 10-to-20% energy loss due to conversion inefficiency, thus decreasing available battery lifetime.

In an example embodiment, the microcontroller 304 and thermistor 310 are powered directly by batteries and can operate over a 1.7-to-5V voltage range while maintaining temperature measurement accuracy. This simplifies the circuitry by eliminating a second power converter that would normally be used to provide a stable supply voltage for the microcontroller. It also extends battery life by eliminating power conversion losses from this second converter.

In an example embodiment, a refrigerator apparatus includes a housing with an interior chamber, a thermoelectric device that is thermally coupled to the interior chamber, and electronics configured to generate and apply input power to the thermoelectric device, the electronics including a microcontroller configured for direct connection to a battery without the use of a voltage regulator.

In an example embodiment, the electronics 300 allow a refrigerator apparatus to operate on external power, power source 320, such as a wall outlet, or through such sources as cigarette lighters or aircraft power sources. In an example embodiment, the power source 320 is a solar cell. By way of example, a solar cell powered embodiment using body-mounted cells and rechargeable batteries accommodates long-term operation away from civilization, e.g., camping or ground shipping of medicines. In an example embodiment, the solar power is monitored and divided between cooling and battery charging as needed. In the example embodiment shown in FIG. 3, the power distribution and conditioning circuit 322 monitors power output by the power source 320 and distributes power between the temperature control circuitry (the microcontroller 304 and the power converter 306) and the battery charger 324.

In an example embodiment, the refrigerator apparatus can be recharged by exchanging batteries, which takes only seconds. Alternatively, the refrigerator apparatus can be recharged in any wall outlet or other convenient power source, such as a cigarette lighter in a car. At the same time, the refrigerator apparatus continues to function as a controlled refrigerator while being recharged. In either case, whether powered by disposable or rechargeable batteries, the substance (e.g., insulin) can be left in the refrigerator apparatus at all times.

The microcontroller 304 can be programmed to implement additional power conservation features such as transitioning the microcontroller 304 to a sleep state or sleep mode, and turning off the temperature measurement circuit when not needed.

In an example embodiment, one or more input/output (I/O) pins of the microcontroller 304 are connected to the communications interface 330, which can include one or more wireless or wired communications mechanisms. In an example embodiment, the microcontroller 304 also includes I/O connections from the ID reader 134 (denoted "ID READER") and to an indicator device, e.g., the display 112, indicator lights 115, and/or speaker 117 (denoted "INDICATOR DEVICE").

In an example embodiment, the microcontroller 304 includes a memory device for storing executable and other program files, as well as data files (e.g., substance-specific temperature control profiles, monitored temperatures and voltages), and user inputs and preferences. Alternately, the memory device is separate from the microcontroller 304, e.g., as part of the electronics 300 and/or remotely located and accessed via the communications link 330. Distributed processing configurations can also be employed.

In an example embodiment, the microcontroller 304 is programmable and is configured (programmed) to monitor the temperature of a substance stored in the refrigerator apparatus and to control the power applied to the thermoelectric device. The microcontroller 304 can be programmed via the communications interface 330. Additionally, in this example embodiment, user inputs to the microcontroller 304 are provided using one or more of the display 112 (e.g., a touch screen) and the user input mechanisms 114.

In an example embodiment, a refrigerator apparatus includes a housing with an interior chamber, a thermoelectric device that is thermally coupled to the interior chamber, a temperature sensing device that is thermally coupled to the interior chamber, the temperature sensing device providing a temperature measurement, an indicator device (e.g., a display, light, and/or speaker), and electronics configured to generate and apply input power to the thermoelectric device. The electronics are configured to monitor the temperature measurement, compare the temperature measurement to a range of acceptable temperatures for a substance stored within the interior chamber, and to control the indicator device to provide an indication of exposure to an unacceptable temperature when the temperature measurement is outside the range of acceptable temperatures.

In an example embodiment, the electronics are configured to track the temperature measurement over time. In an example embodiment, the electronics are configured to provide the indication when the temperature measurement has been outside the range of acceptable temperatures for an unacceptable amount of time for the substance. For example, as a safety feature, in any operating mode, the refrigerator apparatus can be programmed to monitor the temperature extremes of the stored substance, and provide a notice, alarm, indication, or the like (through the display 112, indicator lights 115, and/or speaker 117, for example) that the substance has been exposed to unacceptable temperatures. In an example embodiment, the electronics are configured to apply the input power depending upon an expected lifetime of the substance.

Figure 4:
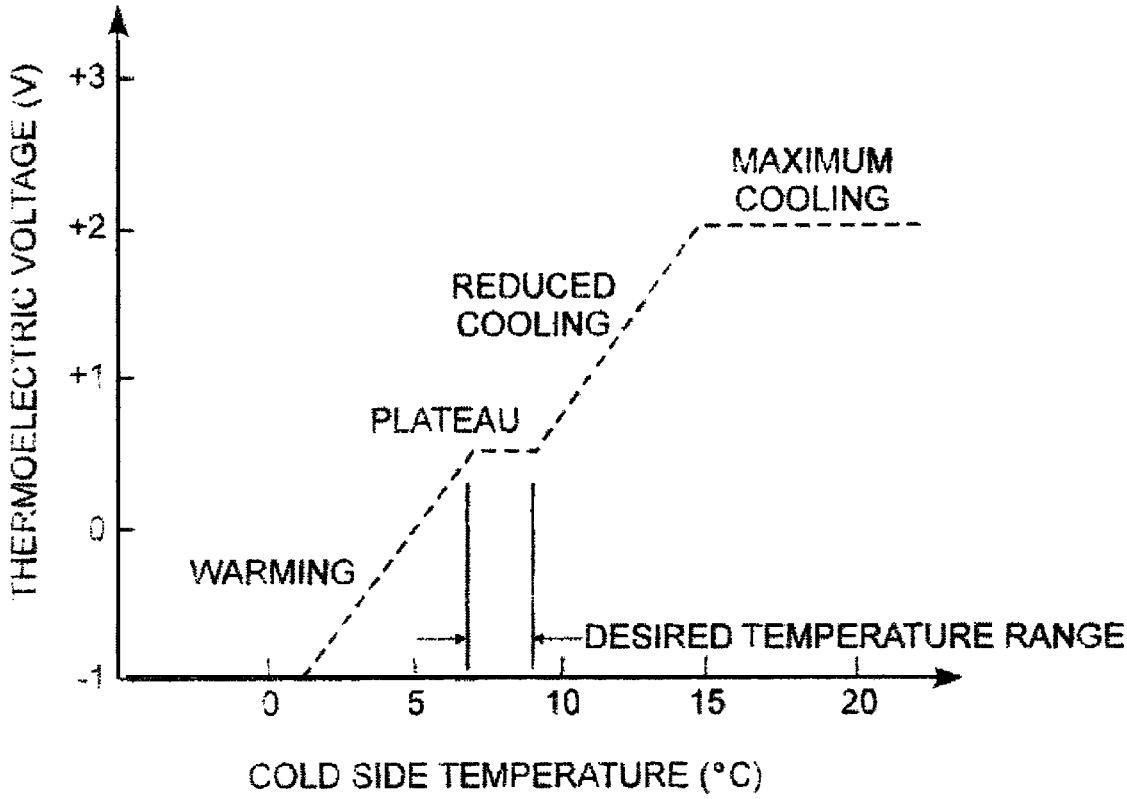
FIG. 4 is a plot of thermoelectric voltage versus cold side temperature according to an example operating mode where a substantially constant input power is applied within a desired temperature range.

FIG. 4 is a plot of thermoelectric voltage versus cold side temperature according to an example operating mode where a substantially constant input power (denoted "PLATEAU") is applied within a desired temperature range. In this range, the thermoelectric voltage applied (in this example, 0.5V) matches the thermal heat load to the cold side. In this example operating mode, at colder temperatures, the thermoelectric voltage is proportionally reduced as shown (denoted "WARMING") to allow normal thermal heat loads to warm the cold side. If the cold side temperature approaches a dangerously cold condition such as freezing for a substance that should not be frozen, the thermoelectric voltage can go negative, thus pumping heat from the outside into the interior. At higher temperatures, thermoelectric cooling is proportionally increased as shown (denoted "REDUCED COOLING") to drop temperatures into the desired range. At still higher temperatures, the maximum thermoelectric voltage (denoted "MAXIMUM COOLING") is reached. In some instances, this limit is either imposed by battery voltage or by the electronics. In other example embodiments, power is applied to either cool or heat even when the cold side temperature is within the desired temperature range, e.g., a non-zero thermoelectric voltage is applied in the PLATEAU region. For example, an external temperature measurement or other input can be processed to determine an adjustment (e.g., offset and/or gain) in the thermoelectric voltage or other modification to the thermoelectric voltage profile for that particular operating mode.

The proportional temperature control schemes described herein can provide increased efficiency and longer battery life than simple on/off cycling of the thermoelectric. This is due to the nonlinear cooling efficiency of a given thermoelectric as a function of input power. The proportional control approach also minimizes thermal cycling within the thermoelectric cooler that can lead to premature failure.

Thermoelectric devices are solid-state heat pumps. They take advantage of the Peltier effect, in which heat is either evolved or absorbed at the junction of two dissimilar electrical conductors when an electric current flows through the junction. In a Peltier cooler, the rate of heat absorption is linearly proportional to the electric current and the difference between the Peltier coefficients of the two conductors. Thus, increasing the current increases the rate of heat pumping. The current cannot be increased without penalty, however, because the conductors used to form the Peltier junction also have an electrical resistance, and the current flow through the conductors will generate resistive heating. This heating is proportional to the square of the electric current. At high currents, therefore, the resistive heating will overwhelm the Peltier cooling and the device will cease to function as a refrigerator.

A consequence of the linear relation between current and Peltier cooling and the quadratic relation between current and resistive heating is that it is preferable to operate a Peltier cooler with a proportional power control. Normal refrigerators, operating on a fluid-dynamic cycle, typically operate with a thermostatically-controlled on-off cycle; when the thermostat detects that the cold zone is warmer than a set point, full power is applied to the cooling unit. When the temperature falls below the set point, the cooling unit is turned off. If the same control scheme is applied to a thermoelectric device, there will be significant inefficiencies in the system. For example, if the average duty cycle of the cooling element is 50%, the current flow during the time that power is on is twice what it would need to be to deliver the same amount of cooling in a continuous manner. Doubling the current will quadruple the resistive heating. The 50% duty cycle will reduce this by a factor of two, so the net increase in resistive heating relative to the steady-state case will be a factor of two. Similarly, if the duty cycle is only 10%, the resistive heating is ten times higher than it would have been in the steady state case. Thus, the most efficient way to operate the cooling elements is with a proportional power control system where the power applied to the cooling elements is just enough to maintain the temperature at the set point.

Figure 5:
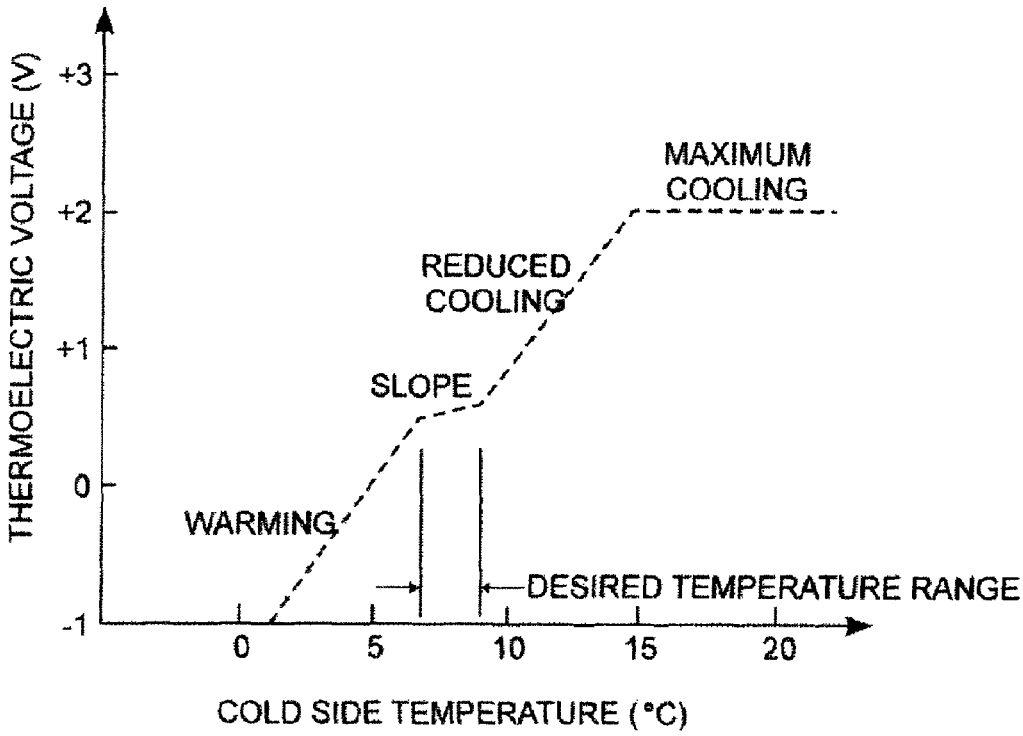
FIG. 5 is a plot of thermoelectric voltage versus cold side temperature according to an example operating mode where a proportional input power is applied within a desired temperature range.

FIG. 5 is a plot of thermoelectric voltage versus cold side temperature according to an example operating mode where a proportional input power (denoted "SLOPE") is applied within a desired temperature range. In this example, the functional relationship between the thermoelectric voltage and the cold side temperature proportionally changes as shown but remains linear within the desired temperature range. In other embodiments, the functional relationship between the thermoelectric voltage and a measured temperature can include proportional relationship(s) and/or non-proportional relationship(s). In other embodiments, the functional relationship is between input power and a measured temperature (or a temperature differential). In still other embodiments, the functional relationship can include discontinuities (i.e., steps) in the thermoelectric voltage (or applied power).

In other embodiments, the microcontroller 304 is programmed to receive user inputs that may override application of power according to a particular operating mode. For example, the boundaries of a desired temperature range can be changed. In other embodiments, only authorized users (such as clinicians) can provide such overriding inputs.

Figure 6:
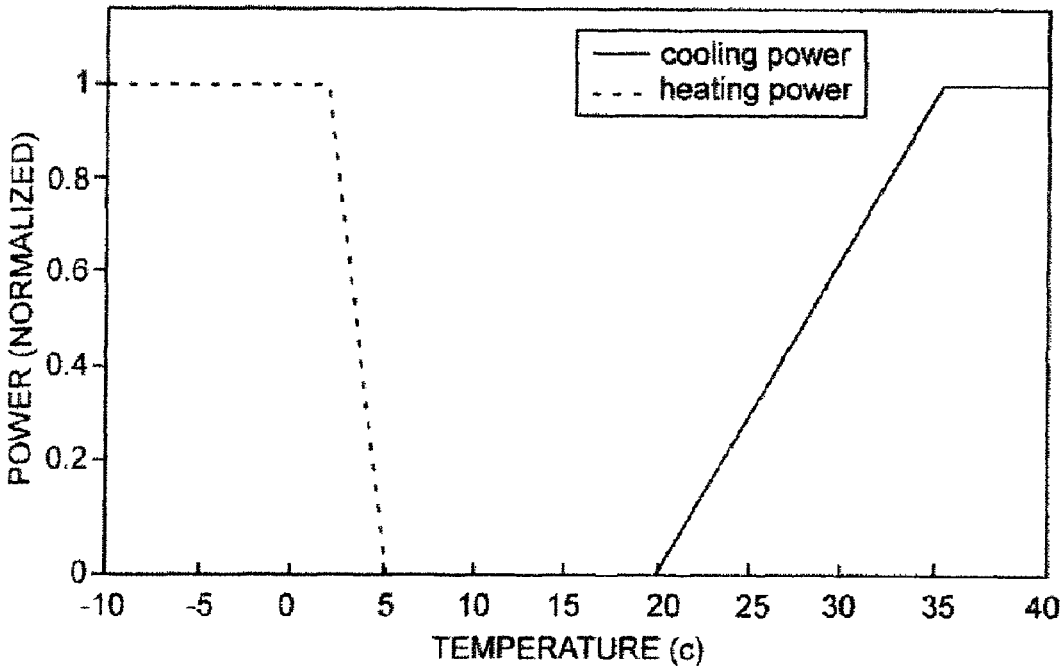
FIG. 6 is a plot of normalized power versus temperature according to an example operating mode where no input power is applied within a desired temperature range.

FIG. 6 is a plot of normalized power versus temperature according to an example operating mode where no input power is applied within a desired temperature range. This operating mode provides an extended range of conditions (in this example, from 5° C. to 20° C.) under which no power is applied. The applied power for any operating mode described herein can be a function of a measured temperature, measured temperatures, a temperature differential, battery voltage, user inputs, and/or other measurements, inputs, data, etc.

As noted previously, the function does not need to be linear. In an example embodiment, a curve with more gentle transitions between regions is provided. When the temperature is in the acceptable range and is stable, there is no need to apply power. As the temperature goes outside this range, the power is gradually increased (either heating or cooling) to attempt to keep the measured temperature in the correct range. In an example embodiment, maximum power is applied only if the temperature goes beyond a limit where the stored substance is subject to (rapid) degradation.

In an example embodiment, a refrigerator apparatus includes a housing with an interior chamber, a thermoelectric device that is thermally coupled to the interior chamber, a temperature sensing device that is thermally coupled to the interior chamber, the temperature sensing device providing a temperature measurement, and electronics configured to generate and apply input power to the thermoelectric device, and to adjust the input power maintaining a functional relationship between the input power and the temperature measurement. In an example embodiment, the functional relationship includes a proportional relationship between the input power and the temperature measurement. In an example embodiment, the input power is adjusted to maintain the functional relationship when the temperature measurement falls outside a range of acceptable temperatures for a substance stored within the interior chamber. In an example embodiment, the input power is adjusted to maintain the functional relationship when the temperature measurement falls inside a range of acceptable temperatures for a substance stored within the interior chamber. In an example embodiment, the input power is held substantially constant when the temperature measurement falls inside a range of acceptable temperatures for a substance stored within the interior chamber. In an example embodiment, no input power is applied when the temperature measurement falls inside a range of acceptable temperatures for a substance stored within the interior chamber. In an example embodiment, the electronics are configured to apply the input power to cause the thermoelectric device to heat the interior chamber only when the temperature measurement indicates a dangerously cold condition for a substance stored in the interior chamber. In an example embodiment, the electronics are configured to apply the input power to cause the thermoelectric device to cool the interior chamber at a maximum available cooling rate of the thermoelectric device only when the temperature measurement indicates a dangerously hot condition for a substance stored in the interior chamber. In an example embodiment, the temperature sensing device is a thermistor circuit, and the electronics include a microcontroller that provides a digital output to activate the thermistor circuit.

An operating mode can be custom tailored to a particular substance, insulin for example. Since insulin can be safely stored for extended periods at temperatures up to 30° C., in an example embodiment, a safety backup operating mode is employed. In normal use, the refrigerator apparatus continuously monitors the temperature of the insulin bottle. When the refrigerator apparatus is in an environment where the temperature is below 30° C., no power is applied to cooling the insulin. When the temperature of the environment rises above 30° C., the power control circuit senses the temperature and applies power to the thermoelectrics to maintain the temperature below 30° C. Since people rarely spend extended periods in environments with temperatures above 30° C., the long-term drain on the batteries is limited. For people who prefer to store their insulin at lower temperatures, the temperature setting of the refrigerator apparatus can be adjusted to any desired value.

In another example operating mode, the insulin is stored in the refrigerator apparatus which is, in turn, stored in a cold environment such as inside a standard refrigerator. If the refrigerator setting is too low, the refrigerator apparatus, being thermoelectric, can operate in reverse as a heater, ensuring that the insulin bottle is not exposed to unacceptably low temperatures.

In another example operating mode, the refrigerator apparatus monitors insulin temperature, external temperatures, and battery voltage and determines an optimum strategy to maximize insulin lifetime (e.g., keep as cool as possible as long as the temperature is above 2° C.) for a fixed operational time (e.g., 24 hours) based on an initial battery capacity (e.g., 2-AA alkaline cells). This mode accommodates users who are uncomfortable with room-temperature insulin.

Additionally, refrigerator apparatuses described herein can be operated in a long-term, wall-powered mode with any desired temperature setting.

In an example embodiment, a refrigerator apparatus includes a housing with an interior chamber, a thermoelectric device that is thermally coupled to the interior chamber, and a temperature sensing device that is thermally coupled to the interior chamber, the temperature sensing device providing a temperature measurement, and electronics configured to receive power from a battery and to generate and apply input power to the thermoelectric device, and to adjust the input power according to an operating mode selected by the electronics depending upon the temperature measurement and a voltage measurement at an output of the battery. In an example embodiment, the operating mode is selected by the electronics to be a normal operating mode when the voltage measurement indicates a sufficiently high battery output voltage, and a low energy reserve operating mode otherwise. In an example embodiment, the electronics, when adjusting the input power in the low energy reserve operating mode, prevent the thermoelectric device from operating at the maximum heating or cooling rates of the thermoelectric device. In an example embodiment, the operating mode includes a functional relationship between the input power and the temperature measurement. For example, the functional relationship includes a proportional relationship between the input power and the temperature measurement. For example, the input power is adjusted to maintain the functional relationship when the temperature measurement falls outside a range of acceptable temperatures for a substance stored within the interior chamber. For example, the input power is adjusted to maintain the functional relationship when the temperature measurement falls inside a range of acceptable temperatures for a substance stored within the interior chamber. In an example embodiment, the input power is held substantially constant when the temperature measurement falls inside a range of acceptable temperatures for a substance stored within the interior chamber. In an example embodiment, the electronics are configured to apply the input power to cause the thermoelectric device to heat the interior chamber only when the temperature measurement indicates a dangerously cold condition for a substance stored in the interior chamber. In an example embodiment, the electronics are configured to apply the input power to cause the thermoelectric device to cool the interior chamber at a maximum available cooling rate of the thermoelectric device only when the temperature measurement indicates a dangerously hot condition for a substance stored in the interior chamber.

When operating on battery power alone, the operating mode is often directed toward maximizing battery lifetime. This is governed by the total energy available in the batteries, the efficiency of the power control system, the efficiency of the thermoelectric modules, and the heat load on the cold side. Both of the later two are functions of the hot side temperature, which is typically somewhere between room temperature and 40° C. In an example operating mode, whenever the room temperature is below 30° C., the only power requirement is for the temperature monitoring function, which can be kept very low. When temperatures go above 30° C., the thermoelectrics cut in, drawing significant battery power. The efficiency of thermoelectric modules is a strong function of the temperature difference across the module. However, with temperature differences smaller than 10° C., the efficiency is very good. The heat load on the cold side can be controlled with insulation.

Since the refrigerator apparatus can encounter a variety of environments, the power required to maintain a stable cold-zone temperature may vary. Various refrigerator apparatus embodiments provide for power control that is a function of both internal and external temperatures.

Figure 7:
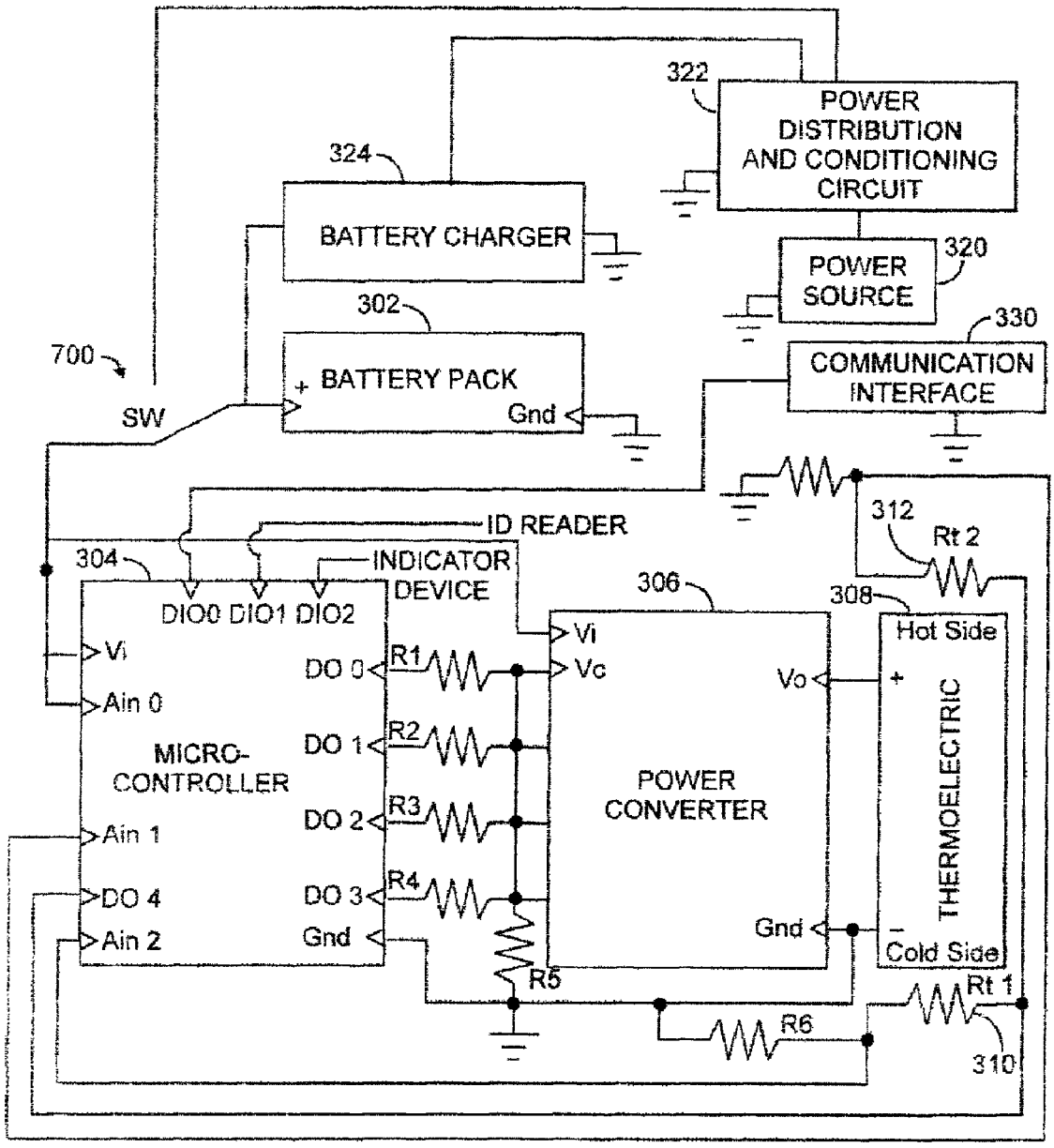
FIG. 7 shows an example embodiment of electronics for a refrigerator apparatus, the electronics including both cold side and hot side temperature sensors.

FIG. 7 shows an example embodiment of electronics 700 for a refrigerator apparatus, the electronics including both cold side and hot side temperature sensors. The electronics 700 are the same as the electronics 300, except as described differently below. In this example embodiment, the electronics 700 include a thermistor 312 which monitors the hot side of the thermoelectric 308. In an alternative embodiment, the thermistor 312 (or other temperature sensing device) is positioned to measure an external temperature. In this example embodiment, the microcontroller 304 monitors two temperature sensors (Rt1 and Rt2 thermistors, in this example embodiment) and the voltage produced by the battery pack 302. In this example embodiment, temperature sensor Rt1 is thermally connected to the cold side of the thermoelectric element while temperature sensor Rt2 is thermally connected to the hot side. In an example embodiment, the microcontroller 304 measures both temperatures, estimates the energy left in the battery pack 302 by measuring its output voltage, and calculates an appropriate driving voltage for the thermoelectric 308.

In an example embodiment, a refrigerator apparatus includes a housing with an interior chamber, a thermoelectric device that is thermally coupled to the interior chamber, temperature sensing devices that provide temperature measurements, and electronics configured to generate and apply input power to the thermoelectric device, and to adjust the input power depending upon the temperature measurements. In an example embodiment, the temperature sensing devices include a first temperature sensing device in thermal contact with one end of the thermoelectric device and a second temperature sensing device in thermal contact with an opposite end of the thermoelectric device. In an example embodiment, the temperature sensing devices include a first temperature sensing device in thermal contact with the interior chamber and a second temperature sensing device in thermal contact with an exterior portion of the housing. In an example embodiment, the electronics are configured to estimate a rate of heat transfer based on the temperature measurements. In an example embodiment, the temperature measurements include an interior chamber temperature measurement, and the input power is adjusted to maintain a functional relationship when the interior chamber temperature measurement falls outside a range of acceptable temperatures for a substance stored within the interior chamber. In an example embodiment, the temperature measurements include an interior chamber temperature measurement, and the input power is adjusted to maintain a functional relationship when the interior chamber temperature measurement falls inside a range of acceptable temperatures for a substance stored within the interior chamber. In an example embodiment, the temperature measurements include an interior chamber temperature measurement, and the input power is held substantially constant when the interior chamber temperature measurement falls inside a range of acceptable temperatures for a substance stored within the interior chamber. In an example embodiment, the temperature measurements include an interior chamber temperature measurement, and the electronics are configured to apply the input power to cause the thermoelectric device to heat the interior chamber only when the interior chamber temperature measurement indicates a dangerously cold condition for a substance stored in the interior chamber. In an example embodiment, the temperature measurements include an interior chamber temperature measurement, and the electronics are configured to apply the input power to cause the thermoelectric device to cool the interior chamber at a maximum available cooling rate of the thermoelectric device only when the interior chamber temperature measurement indicates a dangerously hot condition for a substance stored in the interior chamber.

In example embodiments, multiple different operating modes are available and are selected (automatically, or otherwise) to accommodate normal operating conditions or low energy reserve operating conditions.

Normal Operating Modes:

Example embodiments utilize a database of temperature ranges and/or other control parameters (as conceptually illustrated in Table 1 below). In an example embodiment, a set of temperature ranges is associated with each different substance (drug, hormone, tissue, etc.) If the cold side temperature rises to "Dangerously Warm" levels where the cooled item begins to thermally degrade, the controller will supply maximum cooling until the temperature drops into the "warm" range where thermal degradation is minimal. Conversely, if the cold side temperature drops down to "Dangerously Cold" levels where freezing could destroy the item, the cooler will be operated as a heat pump that pumps heat from the outside to the interior chamber to bring the temperature into the "scold" range. Operation as a heat pump requires reversing the polarity of the voltage applied to the thermoelectric cooler. This can be accomplished using transistor switches, electromechanical relays, or through the use of a selectable second power converter with opposite output polarity.

TABLE 1

Example of Normal Operating Modes

| Category | Dangerously Cold | Cold | Desired | Warm | Dangerously Warm |
|---|---|---|---|---|---|
| Condition: | Potential freezing | Cooler than desired | Optimum | Warmer than desired | Potential degradation |
| Example Range: | <32° F. | >32° F. and <45° F. | >45° F. and <55° F. | >55° F. and <65° F. | >65° F. |
| Action: | Heating | No cooling | No net cooling | Moderate cooling | Maximum cooling |

Example embodiments are directed toward maintaining the cooled item in the "Desired" temperature range while consuming minimum power. Under normal operating conditions, this is accomplished by providing moderate cooling when the item is in the "Warm" condition and no cooling in the "Cold" condition. The term "Moderate Cooling" refers to a cooling rate that changes the internal cold side temperature by less than ~10 degrees per hour. This results in thermal time constants of hours rather than minutes for moving from the "Warm" or "Cold" condition to "Desired". While higher levels of active cooling or heating could be used to quickly drive the temperature towards "Desired", it has been observed that this is less efficient than moderate levels of active cooling or heating. Use of long time constants effectively extends battery lifetime. The term "No net cooling" means the active heat transfer rate out of the cold side produced by the thermoelectric cooler matches the estimated heat transfer rate into the cold side by thermal conduction from the outside world. The term "No cooling" refers to the thermoelectric cooler being off.

In an example embodiment, the microcontroller first estimates the rate of heat transfer into the cold chamber based on the cold side temperature and the hot side temperature. The heat transfer rate is proportional to the temperature difference. The proportionality constant is determined by the physical geometry of the system and the materials used. The microcontroller then calculates a required thermoelectric voltage based on the estimated heat input and the cooling/voltage characteristic for the thermoelectric cooler with the measured hot side/cold side temperature difference. If the current temperature is in the "Optimum" range, the microcontroller will output this voltage to produce zero net cooling. The thermoelectric cooling rate will balance the heat inflow rate. If the current temperature is in the "Warm" range, the microcontroller will output a slightly higher voltage to produce slight excess cooling with a slow drop in temperature over time. If the current temperature is in the "Cold" range, the output voltage is 0; the thermoelectric cooler is turned off.

Low Energy Reserve Modes:

Use of a microcontroller with a battery voltage monitor allows initiation of emergency ultra-low power modes when the battery capacity has been sufficiently exhausted. Battery voltage typically drops as the battery capacity is used up, thus allowing battery voltage to serve as a monitor of remaining battery energy. A low-power indicator such as a light bulb, light emitting diode, liquid crystal display, audio or wireless alarm can be activated to alert the user that the batteries are nearing the end of their operating life and should be changed or recharged. If the low battery warning is ignored and the battery voltage drops further, the controller can shift emphasis from maintaining zero degradation to minimizing thermal degradation as conceptually illustrated in Table 2 below. Under low energy reserve conditions, maximum heating or cooling rates are not used. Moderate heating/cooling rates are used to conserve power in the "Dangerously Cold/Warm" temperature ranges, and no net cooling is used in both the "Desired" and "Warm" temperature ranges. With further degradation in battery energy reserves, the controller will generate either no net cooling or zero cooling until the battery is exhausted.

TABLE 2

Example of Emergency Ultra-low-power Operating Modes

| Category | Dangerously Cold | Cold | Desired | Warm | Dangerously Warm |
|---|---|---|---|---|---|
| Condition: | Potential freezing | Cooler than desired | Optimum | Warmer than desired | Potential degradation |
| Example Range: | <32° F. | >32° F. and <45° F. | >45° F. and <55° F. | >55° F. and <65° F. | >65° F. |
| Action: | Moderate Heating | No cooling | No net cooling | No net cooling | Moderate or no net cooling |

In an example embodiment, a refrigerator apparatus includes a housing with an interior chamber, a thermoelectric device that is thermally coupled to the interior chamber, temperature sensing devices that provide temperature measurements, and electronics configured to receive power from a battery and to generate and apply input power to the thermoelectric device, and to adjust the input power according to an operating mode selected by the electronics depending upon the temperature measurements and a voltage measurement at an output of the battery. In an example embodiment, the temperature sensing devices include a first temperature sensing device in thermal contact with one end of the thermoelectric device and a second temperature sensing device in thermal contact with an opposite end of the thermoelectric device. In an example embodiment, the temperature sensing devices include a first temperature sensing device in thermal contact with the interior chamber and a second temperature sensing device in thermal contact with an exterior portion of the housing. In an example embodiment, the electronics are configured to estimate a rate of heat transfer based on the temperature measurements. In an example embodiment, the temperature measurements include an interior chamber temperature measurement, and the input power is adjusted to maintain a functional relationship between the input power and the interior chamber temperature measurement. For example, the functional relationship includes a proportional relationship between the input power and the interior chamber temperature measurement. In an example embodiment, the temperature measurements include an interior chamber temperature measurement, and the input power is adjusted to maintain a functional relationship when the interior chamber temperature measurement falls outside a range of acceptable temperatures for a substance stored within the interior chamber. In an example embodiment, the temperature measurements include an interior chamber temperature measurement, and the input power is adjusted to maintain a functional relationship when the interior chamber temperature measurement falls inside a range of acceptable temperatures for a substance stored within the interior chamber. In an example embodiment, the temperature measurements include an interior chamber temperature measurement, and the input power is held substantially constant when the interior chamber temperature measurement falls inside a range of acceptable temperatures for a substance stored within the interior chamber. In an example embodiment, the temperature measurements include an interior chamber temperature measurement, and the electronics are configured to apply the input power to cause the thermoelectric device to heat the interior chamber only when the interior chamber temperature measurement indicates a dangerously cold condition for a substance stored in the interior chamber. In an example embodiment, the temperature measurements include an interior chamber temperature measurement, and the electronics are configured to apply the input power to cause the thermoelectric device to cool the interior chamber at a maximum available cooling rate of the thermoelectric device only when the interior chamber temperature measurement indicates a dangerously hot condition for a substance stored in the interior chamber. In an example embodiment, the operating mode is selected by the electronics to be a normal operating mode when the voltage measurement indicates a sufficiently high battery output voltage, and a low energy reserve operating mode otherwise. For example, the electronics, when adjusting the input power in the low energy reserve operating mode, prevent the thermoelectric device from operating at the maximum heating or cooling rates of the thermoelectric device.

As noted above, example embodiments of the electronics include a communications interface, which can be wireless or wired. In an example embodiment, the communications interface facilitates a radio connection (e.g., Bluetooth). In an example embodiment, the communications interface includes a USB port. In an example embodiment, the electronics are configured to receive data and/or control inputs via the communications interface.

Figure 8:
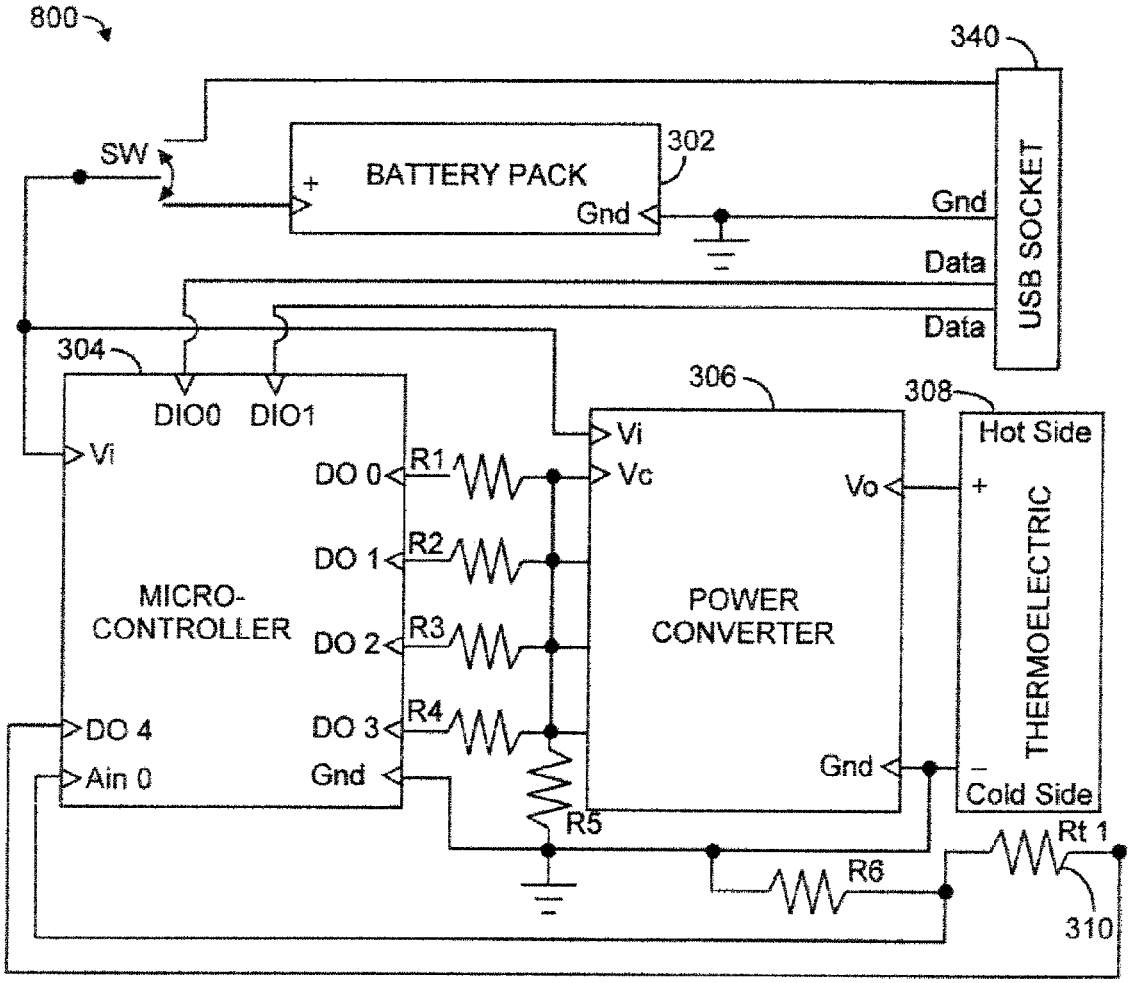
FIG. 8 shows an example embodiment of electronics for a refrigerator apparatus, the electronics including a Universal Serial Bus (USB) interface.
Figure 9:
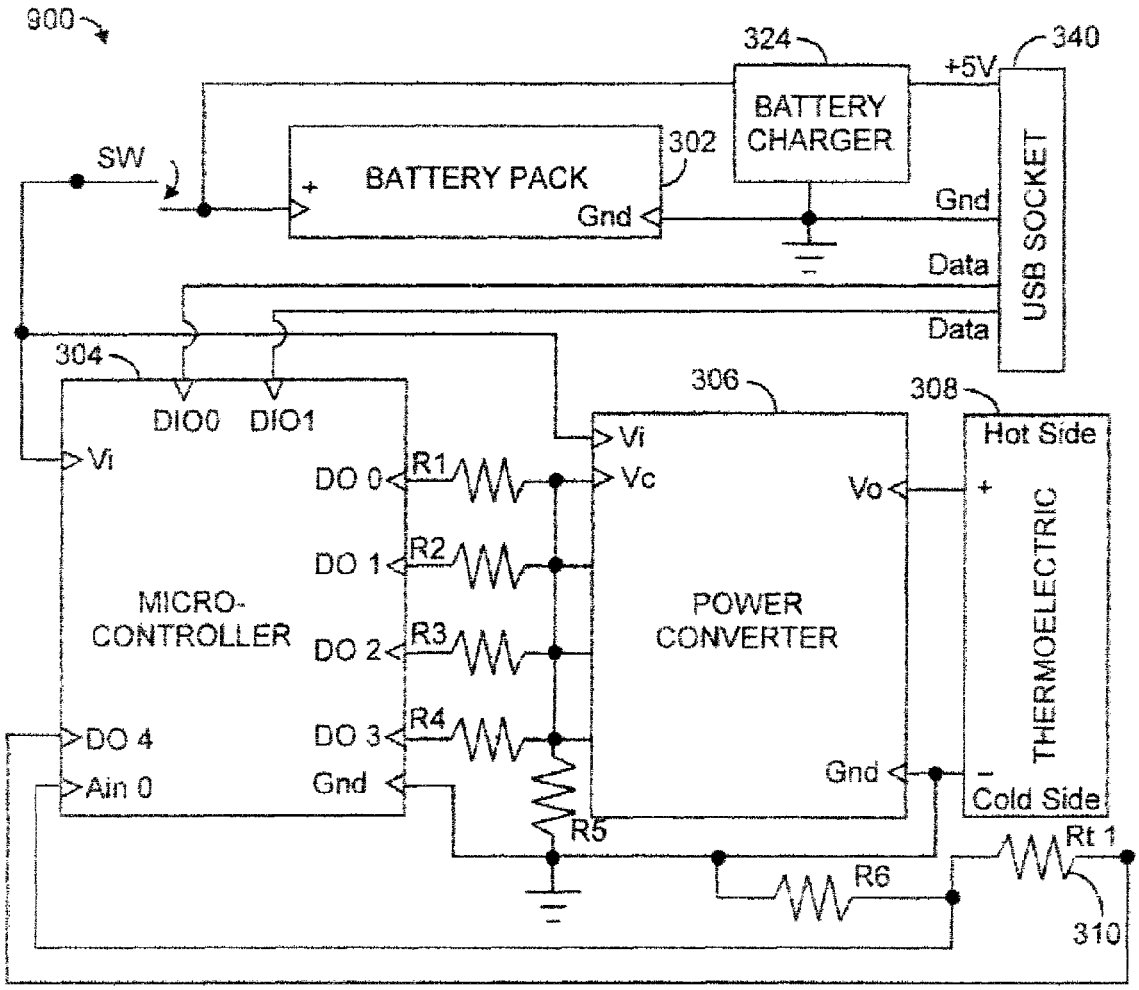
FIG. 9 shows an example embodiment of electronics for a refrigerator apparatus, the electronics including a USB interface and battery charger.

In an example embodiment, the electronics are configured to draw power from the communications interface. FIGS. 8 and 9 illustrate examples of such electronics.

FIG. 8 shows an example embodiment of electronics 800 for a refrigerator apparatus, the electronics including a Universal Serial Bus (USB) interface 340. FIG. 9 shows an example embodiment of electronics 900 for a refrigerator apparatus, the electronics including a USB interface 340 and a battery charger 324. Electronics 800 and 900 are a simplified version of the electronics 300, except as described differently below.

The USB interface 340 facilitates, inter alia, programming the cooler and/or downloading temperature data. In an example embodiment, the microcontroller 304 includes digital input/output pins that can be connected directly to the USB data lines. If the refrigerator apparatus is connected to a computer or powered USB hub by a USB cable, it can also draw power from the computer or hub. USB cables have four wires: a ground wire, a +5 V wire, and a twisted pair for data. The +5 V line can supply up to 500 milliamperes. This +5 V line can be used to power the electronics 800 and 900 for device programming or data readout. Recharging batteries requires additional battery charger circuitry. To this end, electronics 900 additionally include the battery charger 324 configured as shown.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A refrigerator apparatus comprising:

a housing with an interior chamber;

thermoelectric devices that are thermally coupled to the interior chamber; and dual redundant electronics configured to generate and apply input power to the thermoelectric devices;

wherein the dual redundant electronics are configured to apply the input power depending upon an initial strategy of maximizing the lifetime of a substance stored within the interior chamber, the initial strategy being determined based on an operational time expected, temperature ranges specific to the substance, and an initial battery capacity, the dual redundant electronics being configured to operate in a low energy reserve mode under low energy reserve conditions to minimize thermal degradation of the substance, the low energy reserve mode determining the input power as a function of both a measured temperature of the substance and battery energy reserves.

2. The refrigerator apparatus of claim 1, wherein the dual redundant electronics are configured to maintain for each of the thermoelectric devices a functional relationship between the input power and a temperature measurement.

3. The refrigerator apparatus of claim 2, wherein the functional relationship includes a proportional relationship between the input power and the temperature measurement.

4. The refrigerator apparatus of claim 2, wherein the input power is adjusted to maintain the functional relationship when the temperature measurement falls outside a range of acceptable temperatures for a substance stored within the interior chamber.

5. The refrigerator apparatus of claim 2, wherein the input power is adjusted to maintain the functional relationship when the temperature measurement falls inside a range of acceptable temperatures for a substance stored within the interior chamber.

6. The refrigerator apparatus of claim 2, wherein the input power is held substantially constant when the temperature measurement falls inside a range of acceptable temperatures for a substance stored within the interior chamber.

7. The refrigerator apparatus of claim 2, wherein no input power is applied when the temperature measurement falls inside a range of acceptable temperatures for a substance stored within the interior chamber.

8. The refrigerator apparatus of claim 2, wherein the dual redundant electronics are configured to apply the input power to cause the thermoelectric devices to heat the interior chamber only when the temperature measurement drops below a limit where a substance stored in the interior chamber is subject to freezing.

9. The refrigerator apparatus of claim 2, wherein the dual redundant electronics are configured to apply the input power to cause the thermoelectric devices to cool the interior chamber at a maximum available cooling rate of the thermoelectric device only when the temperature measurement exceeds a limit where a substance stored in the interior chamber is subject to degradation.

10. A refrigerator apparatus comprising:

a housing with an interior chamber;

a thermoelectric device that is thermally coupled to the interior chamber;

a temperature sensing device that is thermally coupled to the interior chamber, the temperature sensing device providing a temperature measurement;

an indicator device; and electronics configured to generate and apply input power to the thermoelectric device, the electronics being configured to monitor the temperature measurement, compare the temperature measurement to a range of acceptable temperatures for a substance stored within the interior chamber, and to control the indicator device to provide an indication of exposure to an unacceptable temperature when the temperature measurement is outside the range of acceptable temperatures;

wherein the electronics are configured to apply the input power depending upon an expected lifetime of the substance, to minimize thermal degradation of the substance depending upon temperature ranges specific to the substance and available battery energy reserves.

11. The refrigerator apparatus of claim 10, wherein the indicator device is a display.

12. The refrigerator apparatus of claim 10, wherein the indicator device is a light.

13. The refrigerator apparatus of claim 10, wherein the indicator device is a speaker.

14. The refrigerator apparatus of claim 10, wherein the electronics are configured to track the temperature measurement over time.

15. The refrigerator apparatus of claim 10, wherein the electronics are configured to provide the indication when the temperature measurement has been outside the range of acceptable temperatures for an unacceptable amount of time for the substance.

16. The refrigerator apparatus of claim 10, wherein the electronics include a communications interface.

17. The refrigerator apparatus of claim 16, wherein the communications interface is wireless.

18. The refrigerator apparatus of claim 16, wherein the communications interface facilitates a radio connection.

19. The refrigerator apparatus of claim 16, wherein the communications interface is wired.

20. The refrigerator apparatus of claim 16, wherein the communications interface includes a USB port.

21. The refrigerator apparatus of claim 16, wherein the electronics are configured to draw power from the communications interface.

22. The refrigerator apparatus of claim 16, wherein the electronics are configured to receive data via the communications interface.

23. The refrigerator apparatus of claim 16, wherein the electronics are configured to receive control inputs via the communications interface.

24. The refrigerator apparatus of claim 10, wherein the interior chamber is configured to provide a data input to the electronics that identifies the substance.

25. The refrigerator apparatus of claim 10, wherein the interior chamber is complementary in shape to a container in which the substance is stored.

26. A refrigerator apparatus comprising:

a housing with an interior chamber wall that is made from a thermally conductive material, the interior chamber wall defining an interior chamber for receiving a container, the interior chamber being complementary in shape to a container;

a thermoelectric device that is thermally coupled to the interior chamber wall;

layers of aerogel fabric within the housing for insulating the thermoelectric device, each of the layers of aerogel fabric being a flexible sheet of porous aerogel composite material with fiber reinforcing structures; and electronics configured to generate and apply input power to the thermoelectric device wherein the layers of aerogel fabric are separated from the interior chamber by the interior chamber wall and control the heat load on the cold side of the thermoelectric device.

* * * * *